United States Patent [19]

Mok et al.

[11] Patent Number: 4,833,428

[45] Date of Patent: May 23, 1989

[54] 14/12 GHZ DUPLEXER

[76] Inventors: Chuck K. Mok, 419 Halford Road, Beaconsfield, Quebec; Alain Martin, 46 St. Michel, Vaudreuil, Quebec, both of Canada

[21] Appl. No.: 126,569

[22] Filed: Nov. 30, 1987

[30] Foreign Application Priority Data

Dec. 4, 1986 [CA] Canada ..... 524491

[51] Int. Cl.[4] ..... H01P 1/207; H01P 1/213; H01P 5/12

[52] U.S. Cl. ..... 333/135; 333/208; 333/212; 333/248

[58] Field of Search ..... 333/208, 209, 210, 211, 333/212, 1, 100, 110, 126, 202–207, 248, 134, 135, 137, 132; 370/30, 38; 455/19, 78, 81, 82

[56] References Cited

U.S. PATENT DOCUMENTS

| | | | |
|---|---|---|---|
| 2,421,033 | 5/1947 | Mason | 333/134 |
| 2,588,226 | 3/1952 | Fox | 333/208 |
| 2,984,798 | 5/1961 | Bryan | 333/134 |
| 3,157,847 | 11/1964 | Williams | 333/248 X |
| 3,204,205 | 8/1965 | Rowland | 333/209 X |
| 3,497,835 | 2/1970 | Tsuda | 333/210 |
| 3,579,153 | 5/1971 | Wang | 333/209 |
| 3,727,152 | 4/1973 | Bodonyi | 333/135 |
| 4,200,847 | 4/1980 | Nishikawa et al. | 333/125 |

FOREIGN PATENT DOCUMENTS

| | | | |
|---|---|---|---|
| 3208029 | 9/1983 | Fed. Rep. of Germany . | |
| 723919 | 2/1955 | United Kingdom | 455/81 |
| 950094 | 2/1964 | United Kingdom . | |
| 987460 | 3/1965 | United Kingdom . | |
| 1007967 | 10/1965 | United Kingdom . | |

OTHER PUBLICATIONS

IRE Transactions on Microwave Theory and Techniques, vol. MIT-10, No. 6, Nov. 1962, pp. 416–427, New York, US: L. Young et al.: "Microwave Band-Stop Filters with Narrow Stop Bands".

*Primary Examiner*—Marvin L. Nussbaum
*Attorney, Agent, or Firm*—Brooks Haidt Haffner & Delahunty

[57] ABSTRACT

A duplexer for use in a feed network for a satellite communications antenna is made in waveguide form and comprises two plate halves each with a pattern of channels on one surface, the pattern on one half being the mirror image of the pattern on the other. When the two halves are assembled with the patterned faces juxtaposed, a receive filter and a transmit filter with receive, transmit and common ports are obtained. Each filter has a main waveguide and several short-circuited half wavelength stubs in serial connection to the main waveguide. The joint between the two halves bisects the waveguide broadwall and is, therefore, of no electrical significance. The simplicity of the design lends itself to fabrication as part of a bigger integral assembly consisting of duplexers and other feed components. After manufacture, no further tuning is necessary.

13 Claims, 1 Drawing Sheet

14/12 GHZ DUPLEXER

BACKGROUND OF THE INVENTION

This invention relates to duplexers of the type used for satellite antennas.

Typically, a satellite antenna comprises a cluster or array of individual horns positioned to direct individual radio frequency beams onto a reflector which redirects a combined beam to the desired coverage area of the earth.

A feed network for the satellite antenna comprises a transmit network, a receive network and a duplexer array (also known as a diplexer) the purpose of which is to allow the transmit and receive networks to share the same array of horns by separating the transmit signals from the receive signals.

A conventional duplexer for K-band operation (14/12 GHz) is realized using waveguide WR75. The duplexer comprises a transmit filter and a receive filter connected together in generally a V configuration to form a common port for connection to the horn array and separate transmit and receive ports. Each filter is typically a 4-pole Chebyshev design, with direct coupling between resonators. The coupling elements are inductive irises soldered to the waveguide body and spaced apart approximately a half wavelength. Tuning screws and coupling adjustment screws are employed to overcome the problem of dimensional tolerances in manufacture and to achieve the correct inter-cavity coupling and centre frequency.

The main disadvantages with this prior duplexer are, firstly, that it requires careful tuning on an individual basis and, secondly, it is relatively difficult to manufacture and does not lend itself readily to fabrication as part of a larger assembly.

SUMMARY OF THE INVENTION

It is an object of the present invention to provide a duplexer which obviates or mitigates these drawbacks.

According to a broad aspect, the present invention provides a duplexer for coupling a transmit line and a receive line to an antenna horn, comprising a transmit filter and a receive filter, the transmit filter comprising a transmit port connected to a first main waveguide, a first plurality of short-circuited stubs in series connection to the first main waveguide, the stubs having a nominal length any multiple of a half wavelength at the midband of the transmit frequency, the spacing between the stubs being nominally any odd multiple of a quarter wavelength at the transmit frequency, the width of the stubs being determined by the desired transmit filtering parameters, the receive filter comprising a receive port connected to a second main waveguide, a second plurality of short-circuited stubs in series connection with the second main waveguide, the stubs having a nominal length any multiple of a half wavelength at the midband of the receive frequency, the spacing between the stubs being nominally any odd multiple of a quarter wavelength at the receive frequency, the width of these stubs being determined by the desired receive filtering parameters, a common port being connected to a junction between the first and second main waveguides for connection to the antenna horn.

DESCRIPTION OF THE PREFERRED EMBODIMENT

Figure 1:
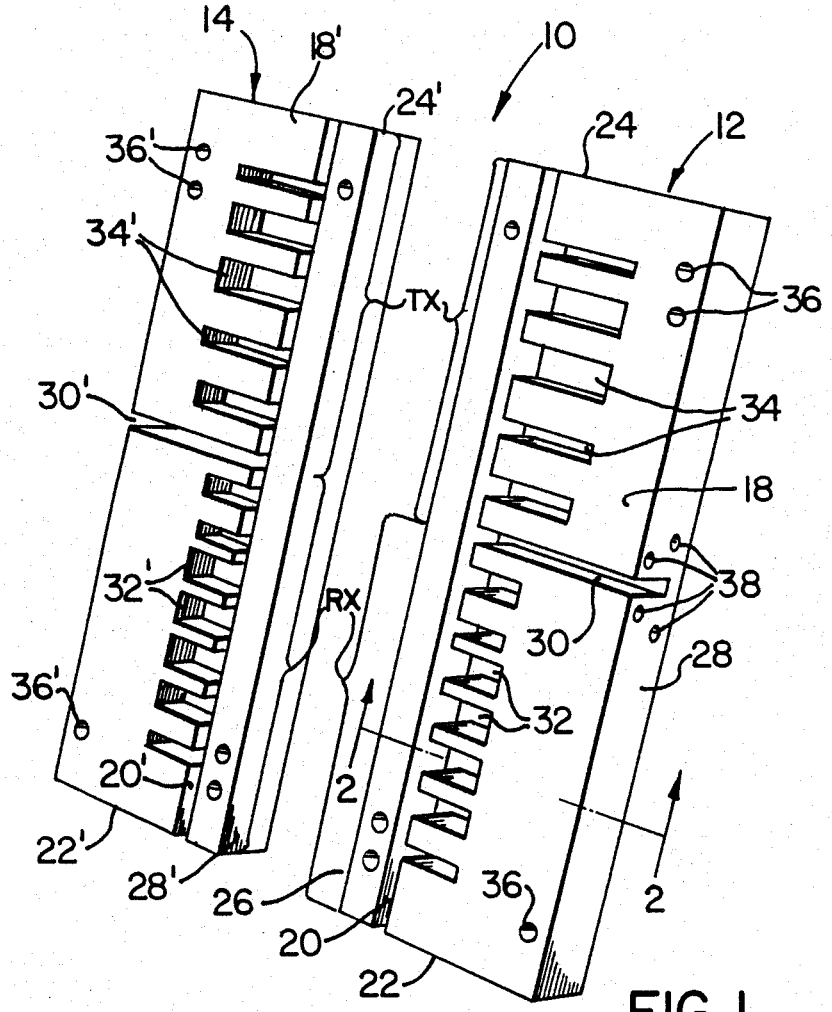
FIG. 1 is an unassembled perspective view of the two major components of a duplexer constructed according to the principles of the present invention.

Referring to the drawings, the duplexer 10 is formed of two similar aluminum plate halves 12 and 14. The underside 16 of half 12 is generally planar and the upper side 18 has been milled to form a main elongate rectangular channel 20 extending between opposite ends 22 and 24 parallel to the longer sides 26 and 28 and nearer to side 26, a central transverse rectangular channel 30 extending between channel 20 and side 28, a first set of seven stub channels 32 located between end 22 and channel 30 and extending parallel to channel 30 partway towards side 28 and a second set of five stub channels 34 located between end 24 and channel 30 and also extending parallel to channel 30 partway towards side 28. As can be seen, channels 34 are longer than channels 32.

Holes 36 extending through the half 12, communicating with sides 16 and 18. Blind holes 38 are formed on side 28 proximate channel 30 and on both sides of channel 30 and similar holes (not shown) are provided on ends 22 and 24 on both sides of channel 20.

Figure 2:
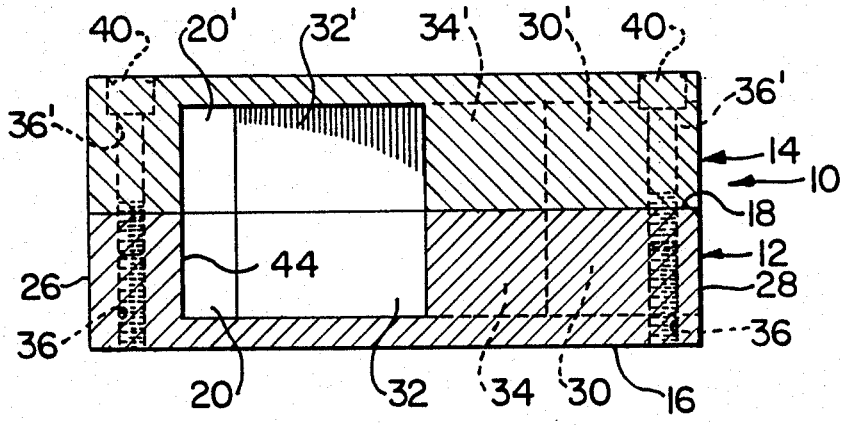
FIG. 2 is an assembled sectional view of the duplexer taken on lines 2—2 of FIG. 1.

Duplexer half 14 has a pattern on its upper side (as seen in FIG. 1) 18' of rectangular channels and holes which forms an extract mirror image of the pattern of channels and holes on duplexer half 12. The channels and holes in half 14 are identified by the same reference numerals as those used for corresponding channels and holes in half 12 except that a prime notation has been added. The effect of the mirror image is that when the duplexer half 14 is inverted and placed on top of half 12 as seen in FIG. 2 the channels and holes of the two halves become respectively aligned. The channels thus aligned form waveguides, stubs and ports. For example channels 20 and 20' together form a waveguide and each stub channel 32 and 32' together form a stub. Although each waveguide or stub is thus formed of two channel sections identified by a number without a prime notation and the same number with a prime notation, in the following discussion for simplicity the number without the prime notation will be used alone to denote the waveguide or stub. The two halves are secured together by means of machine screws 40 being received through holes 36 and 36'.

It can be seen that the assembled duplexer can be divided into two main portions, namely a portion extending from end 22, 22' to waveguide 30 which will be referred to as the receiver portion RX and a portion extending from end 24, 24' to waveguide 30 which will be referred to as the transmitter portion TX.

The receiver portion RX is a waveguide filter comprising a main waveguide formed by one half of waveguide 20 and the seven short-circuited stubs 32 which are in series connection with the main waveguide. The stubs 32 are nominally a half wavelength long at the midband of the receiving frequency and, as can be seen in FIG. 1, the stub widths, i.e., dimension in direction parallel to main waveguide, vary; in the specific embodiment illustrated, the lowermost stub 32 is narrow, the next stub slightly wider, the next three stubs all slightly wider still, the sixth stub narrower and the last stub wider than the sixth. The configuration and values of widths are determined according to required filter characteristics. The spacing between the stubs is nominally a quarter wavelength but because of the well known phenomenon of "junction effect", the spacing is varied from that nominal value according to the width of the stubs; specifically, the spacing between narrow stubs is greater than the spacing between wider stubs.

The stubs 32 present series shorts to the main waveguide 30 at the passband but present finite reactances at other frequencies, thereby causing reflection.

It should be understood that the nominal stub length may be any multiple of $\lambda/2$ and the nominal stub spacing may be any odd multiple of $\lambda/4$. Furthermore, the exact number of stubs is determined by the requirements and may, typically, be between 2 and 10.

The transmitter portion TX is a waveguide filter comprising a main waveguide formed by the other half of waveguide 20 and the five short-circuited stubs 34 which are in series connection with the main waveguide. The above description of stubs 32 applies to stubs 34 except that stubs 34 are nominally a half wavelength along at the midband of the transmitting frequency and so stubs 34 are longer. Moreover, of course, the nominal $\lambda/4$ spacing also refers to the transmitting frequency.

The location at which waveguide 20 opens on to end 22 is known as a receiver port and, in the "breadboard" configuration illustrated, a receive line of a receive network could be coupled to this port using the holes provided in end 22 and fastening means such as screws. Similarly, waveguide 20 becomes a transmitter port at end 24 and a transmit line of a transmit network can be coupled to that port. Waveguide 30 constitutes a common port which can be coupled by holes 38 and screws to a horn of a horn array. In an actual production configuration, the duplexer of the invention would typically not be manufactured as a separate device requiring connection to other devices in the system but would be integrated with those other devices. Thus, there would be no ends 22 and 24 and, of course, no holes and fasteners.

An important feature of the present invention is that, as can be seen in FIG. 2, the joint between the two assembles halves 12, 14 of the duplexer lies on a plane which bisects the broadwall 44 of the waveguide 20. As the stubs and waveguide 30 are all the same depth as waveguide 20, it is clear that this plane also bisects the broadwall of every stub. The mode of propagation is the $TE_{10}$ mode and this has no transverse current across the joint. Electrically, therefore, the joint is of no consequence.

The broadwall dimension of channels 20 and 30 is typically 0.75" with the height 0.1". The nominal values of stub length and spacing are $\lambda/2$ and $\lambda/4$ respectively but, in practice, the specific dimensions of the stubs for optimum performance are arrived at with the assistance of approximate computer programming. For the RX portion the following approximate values are typical. Some of the stubs are longer than others, the range being approximately 0.39" to 0.44". As can be seen clearly in FIG. 1 the stub widths and spacings also differ, the widths being in the range of approximately 0.07" to 0.20" and the spacings being in the range of approximately 0.27" to 0.30". For the TX portion, the stub lengths are in the range 0.65" to 0.72", the widths in the range 0.08" to 0.22" and the spacings in the range 0.30" to 0.39".

In the specific embodiment illustrated the stubs 32 and 34 extend from only one side of the main waveguide 20 but the receive portion RX and the transmit portion TX could each have double-sided stubs, i.e., stubs extending from both sides of the main waveguide 20. Another feasible arrangement would be to have the stubs 32 extend in one direction and the stubs 34 extend in the opposite direction from main waveguide 20. However, both of these alternative suggestions would increase the width of the duplexer.

Another possible modification is the stepping of one or more of the stubs 32 or 34 so that the stub in question comprises a first $\lambda/4$ long portion of a first width and a second $\lambda/4$ portion of a second width. The wider portion, in one embodiment, is nearer the main channel than is the narrower portion but, in another embodiment, the narrower portion is nearer the main channel. This feature allows the stop band performance to be altered, if required.

In the illustrated embodiment, the common port 30 is shown exiting on side 28 but different arrangements are envisaged. For example, in a particularly useful embodiment, port 30 has a 90° bend about half-way between channel 20 and side 28, the end portion of port 30 then running parallel rather than perpendicular, to channel 20 to exit at end 22. This configuration allows the overall width of the device to be reduced.

To minimize the width of the duplexer and to obtain a design which can easily be modelled mathematically, it is preferred that the TX and RX portions be exactly aligned, i.e., with the main waveguide of each being in line but the invention is not considered limited to such an arrangement and, in practice, the two duplexer portions could be arranged so that they define different angles between them for example 90° such that the main waveguide of TX for example would exit from a side, not an end, of the device.

The advantages of the duplexer of the invention are, firstly, that each stub is matched at midband so that each filter portion is inherently more tolerant of dimensional errors and requires no further tuning and, secondly, the simple design permits easy manufacture as an integrated assembly.

What we claim as our invention is:

1. A duplexer for coupling a transmit line for transmitting signals at a transmit frequency and a receive line for receiving signals at a different receive frequency to an antenna horn, said duplexer comprising a conductive plate, said conductive plate having:

a relatively long and narrow first main channel therein forming at least part of a first main transmit waveguide with a transmit port at one end and having an opposite end;

a plurality of first stub channels extending transversely to the length of said first main channel and in spaced relation to each other and forming short-circuited stubs coupled to said first main channel, said first stubs having a nominal length extending transversely to said length of said first main channel of any multiple of a half wavelength at the midband of the transmit frequency, a nominal spacing in the direction of said length of said first main channel of any odd multiple of a quarter wavelength at the midband of the transmit frequency and a width selected to provide the desired transmit filtering parameters;

a relatively long and narrow second main channel therein forming at least part of a second main receive waveguide with a receive port at one end and having an opposite end;

a plurality of second stub channels extending transversely to the length of said second main channel and in spaced relation to each other and forming shortcircuited stubs coupled to said second main channel, said second stubs having a nominal length extending transversely to said length of said first main channel of any multiple of a half wavelength at the midband of the receive frequency, a nominal spacing in the direction of said length of said second main channel of any odd multiple of a quarter wavelength at the midband of the receive frequency and a width selected to provide the desired receive filtering parameters; and a common antenna port coupled to said opposite end of first main transmit waveguide and to said opposite end of said second main receive waveguide; and a conductive cover overlying all said channels and conductively connected to said conductive plate.

2. A duplexer according to claim 1 wherein said first main channel and said second main channel have their lengths in mutual alignment with said opposite end of said first main waveguide adjacent said opposite end of said second main waveguide.

3. A duplexer according to claim 2 wherein said common port is coupled to opposite ends of the main waveguides by a further channel in said plate extending from said common port to said opposite ends.

4. A duplexer according to claim 3 wherein said further channel extends in a direction perpendicular to the lengths of said first main channel and said second main channel.

5. A duplexer according to claim 3 wherein said further channel has a first portion which extends from said opposite ends perpendicularly to the lengths of said first main channel and said second main channel and a second portion which extends from said first portion in a direction parallel to the last-mentioned said lengths and to an end of said plate.

6. A duplexer according to claim 5 wherein said receive port is at one end of said plate and wherein said second portion extends from said first portion to the last-mentioned said end of said plate.

7. A duplexer according to claim 2 wherein said plurality of first stub channels extend in a first direction from said first main channel and said plurality of second stub channels extend in a second direction, opposite to said first direction, from said second main channels.

8. A duplexer according to claim 7 wherein the depths of the channels in the first-mentioned said plate from the surface of the first-mentioned said plate is substantially equal to the depths of the channels in said further plate from the surface of the latter whereby the joint between the first-mentioned said plate and said further plate is substantially mid-way between the respective bottoms of said channels.

9. A duplexer according to claim 2 wherein stub channels of said plurality of first stub channels extend in opposite directions from said first main channel and stub channels of said plurality of second stub channels extend in opposite directions from said second main channel.

10. A duplexer according to claim 1 wherein all said first stub channels extend in the same direction with respect to said first main channel and all said second stub channels extend in the same direction with respect to said second main channel.

11. A duplexer according to any one of claims 7, 9 and 10 wherein at least some of said stub channels are formed by a first portion of a first width and a length of one-quarter wavelength in series with a second portion of a second, different width and a length of one-quarter wavelength.

12. A duplexer according to claim 1 wherein at least some of said stub channels have a width in the direction of the lengths of the main channel to which they are coupled which is different from the corresponding width of other stub channels.

13. A duplexer according to claim 1 wherein said cover is a further conductive plate with channels therein overlying the channels of the first-mentioned said conductive plate and arranged as the mirror image of the first-mentioned said plate so that each waveguide and stub is formed in part by a channel in the first-mentioned said plate opposing a channel in said further plate.

* * * * *